United States Patent [19]

Waltonen

[11] Patent Number: 4,635,069

[45] Date of Patent: Jan. 6, 1987

[54] MUTUAL-COUPLING MULTI-ELEMENT FM ANTENNA

[75] Inventor: James R. Waltonen, Haines, Oreg.

[73] Assignee: IRT, Inc., Haines, Oreg.

[21] Appl. No.: 595,627

[22] Filed: Apr. 2, 1984

[51] Int. Cl.[4] ..... H01Q 21/20

[52] U.S. Cl. ..... 343/799; 343/814

[58] Field of Search ..... 343/792.5, 803, 804, 343/876, 814, 799, 800, 810, 812, 844

[56] References Cited

U.S. PATENT DOCUMENTS

| | | | |
|---|---|---|---|
| 2,387,116 | 10/1945 | Bruce | 343/844 |
| 2,533,900 | 12/1950 | Shanklin | 343/803 |
| 2,576,748 | 11/1951 | Carmichael | 343/804 |
| 3,299,429 | 1/1967 | McMullin | 343/803 |
| 3,503,074 | 3/1970 | Carter | 343/792.5 |
| 3,626,418 | 12/1971 | Berryman | 343/742 |
| 3,852,766 | 12/1974 | Olson et al. | 343/844 |
| 3,996,592 | 12/1976 | Kline et al. | 343/876 |

*Primary Examiner*—Eli Lieberman

*Attorney, Agent, or Firm*—Kolisch, Hartwell & Dickinson

[57] ABSTRACT

An FM antenna for use with a radio receiver which features plural, elongate open loop reception elements which are mutually coupled to one another. These elements may be equidistantly arranged about and spaced from an axis generally parallel with the element sides. The antenna is particularly effective for receiving weak and/or distant FM signals.

7 Claims, 4 Drawing Figures

MUTUAL-COUPLING MULTI-ELEMENT FM ANTENNA

BACKGROUND AND SUMMARY OF THE INVENTION

This invention pertains to antennas to be used with an FM radio receiver. More particularly, the invention pertains to a high gain antenna with plural, mutually coupled conductive elements connected electrically in parallel which is particularly useful in areas where FM radio signals are weak and/or of distant origin.

Known antennas which have been developed for use in weak signal areas utilize a variety of structures to enhance reception of radio frequency (RF) energy. The most common structure used to enhance reception is a parasitic element. This element may be positioned adjacent, or several elements may surround, a primary conductive reception element.

Additionally, multiple conductive reception elements may be utilized, with or without associated parasitic elements, by coupling reception elements together, usually after such elements are positioned at varying heights, or with varying orientations, on a single antenna mast.

A third form of antenna utilizes an electrically conductive framework as a carrier for a conductive reception element which is electrically insulated from the framework but which is thought to derive some additional signal from the proximal association of the conductive framework.

Most known antennas require precise alignment with an FM transmission site in order to optimally receive signals from a specific site. This requires that antennas either be rotatably mounted, or be constantly adjusted for proper alignment. Additionally, the requirement for precise alignment makes the antennas particularly susceptible to variations in reception quality as a result of changes in atmospheric condition.

A general object of the instant invention is to provide a high gain RF antenna.

A further object of the invention is to provide an FM antenna which will provide parallel paths for RF energy.

Another object is to provide an FM antenna which does not require the use of parasitic elements.

A fourth object of the instant invention is to provide an FM antenna which will optimally function in a known frequency range.

Another object is to provide an FM antenna which is simple in construction and, therefore, inexpensive to manufacture.

A further object of the invention is to provide an FM antenna which does not need to be oriented in a specific direction to receive an RF signal from a specific transmitter.

The preferred embodiment of the instant invention includes a non-electrically conductive framework, which carries plural opened-loop, spaced-apart conductive reception elements. The conductive elements are electrically mutually coupled to one another intermediate the ends of the elements. An antenna lead is provided to connect the coupled elements to an FM radio receiver. The frame and conductive elements may be suitably enclosed in a supportable weather-tight container for suspension in outdoor conditions.

These and other objects and advantages of the antenna of my present invention will become more fully apparent as the description which now follows is read in conjunction with the attached drawings.

DETAILED DESCRIPTION OF THE INVENTION

Figure 1:
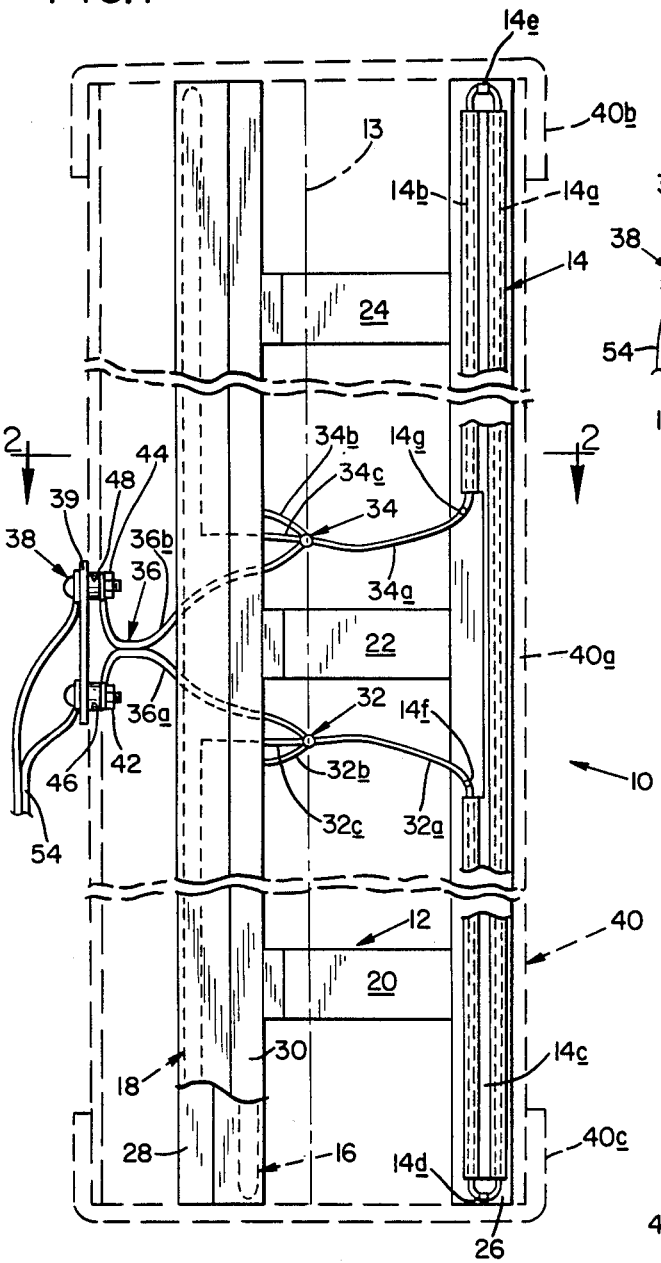
FIG. 1 is a side elevation of an antenna constructed in accordance with the instant invention.
Figure 2:
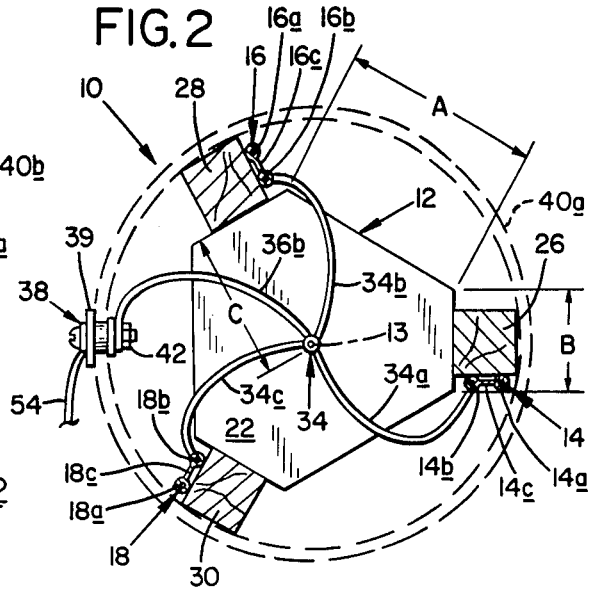
FIG. 2 is a cross section taken generally along the line 2—2 in FIG. 1.
Figure 3:
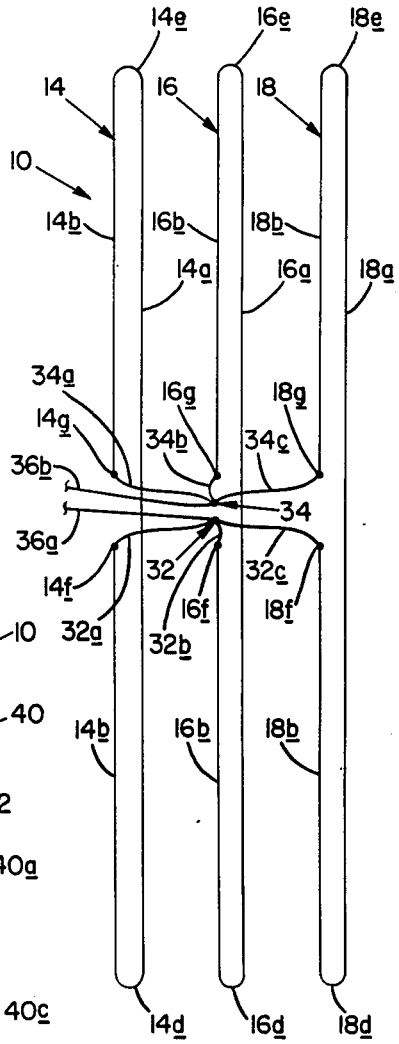
FIG. 3 is a schematic diagram of the antenna.

Turning now to the drawings with particular reference to FIGS. 1 and 2, a mutually-coupled multi-element FM antenna is shown generally at 10. Antenna 10 includes a non-electrically conductive frame, shown generally at 12, and plural, elongate open-loop conductive reception elements, or dipole pairs, shown at 14, 16 and 18, mounted on the frame.

Frame 12 is constructed of wood or plastic to carry the reception elements in a precise arrangement relative one another. To this end, the frame includes spacers or forms 20, 22 and 24, which are irregular-hexagonal structures disposed along frame 12 major axis 13. Forms 20, 22, 24 have three longer sides, each having the dimension A shown in FIG. 2. Interposed thee three longer sides are three shorter sides having a dimension B. The three shorter sides are disposed a common distance C from axis 13. Three square-rod-shaped conductive-element carriers 26, 28 and 30 are affixed one each on the three shorter form sides as shown. This arrangement provides that the carriers are spaced at approximately 120° angles about the periphery of the forms.

The reception elements, as exemplified by element 14, are formed from conventional flat, twin-lead wire. The wire contains two parallel multi-strand conductors, **14*a*, 14*b*, which are electrically separated by a web 14*c* of insulative material which extends integrally around the conductors. Twin-lead wire is cut to a predetermined length corresponding to a desired signal wavelength, as will be discussed further later. A portion of the insulative web material is removed from each end to provide short lengths of exposed conductors. Conductors 14*a* and 14*b* are then joined together at these ends, as shown generally at 14*d* and 14*e*, to form a temporarily closed loop. A portion of web 14*c* is removed adjacent the middle of conductor 14*b*. The exposed conductor is then cut, thereby forming first and second electrically spaced terminals 14*f*, 14*g***, respectively. The formation of the terminals provides a discontinuity in the loop, making the previously closed loop a now opened loop.

The now open-loop conductive reception elements are mounted on the carriers, as shown in FIGS. 1 and 2. The mounted elements are equidistant from, and parallel with the major axis 13 of the frame.

Reception elements 14, 16 and 18 are electrically joined at their terminals to what is referred to herein as mutual coupling means, or mutual couplers. Specifically, a mutual coupler 32, or first coupling means, has connectors **32*a*, 32*b* and 32*c* which are joined to terminals 14*f*, 16*f* and 18*f*, respectively. Likewise, mutual coupler 34, or second coupling means, has connectors 34*a*, 34*b* and 34*c* which are joined to terminals 14*g*, 16*g* and 18*g***, respectively.

An antenna lead wire 36, formed in the preferred embodiment from twin-lead material similar to that used for the reception elements, has a first lead 36*a* connected to coupler 32, and a second lead 36*b* connected to coupler 34. Lead 36 extends from the couplers to an antenna connection terminal 38 which, in the preferred embodiment, is fixed to the side of a weather-tight container 40, shown in dashed lines, which encloses the antenna.

Terminal 38 includes an elongate insulating base plate 39 mounted on a container body 40*a* intermediate its ends by nut and bolt assemblies 42, 44. The bolts associated with assemblies 42, 44 extend through ports 46, 48 in container body 40*a* as shown.

Figure 4:
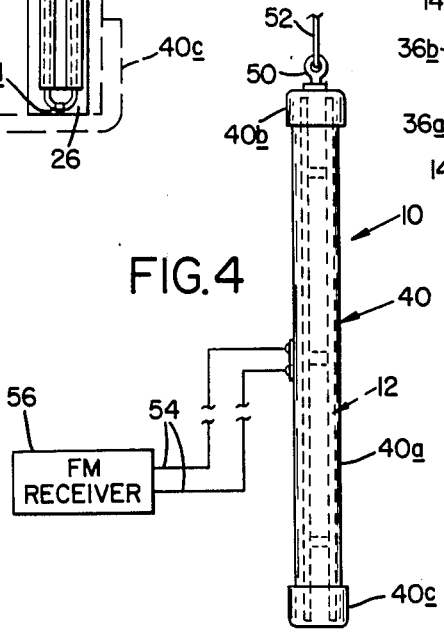
FIG. 4 is a schematic view of the antenna of FIG. 1 enclosed in a weather-tight case and connected to an FM receiver.

FIG. 4 more specifically depicts the frame and reception elements of the instant invention enclosed in the container. Container 40, preferably formed of PVC material, includes container body 40*a* and bottom and top end caps 40*c* and 40*b*, respectively. End cap 40*c* has an I-bolt 50 secured to the top of it. The antenna and container are suspended from a cord, which is attached to a beam or other suitable support structure.

An antenna lead wire 54 is connected between terminal 38 and an FM receiver 56. Lead wire 36, terminal 38 and lead wire 54 collectively comprise what is referred to herein as lead means. The individual conductors and terminals within the leads comprise what are referred to herein as first and second leads. It is intended that antenna 10, when enclosed in container 40, may be positioned outside of a building and lead 54 run between the antenna and an FM receiver inside the building.

The dimensions and relative positions of the elements of the antenna determine what radio frequencies will be most effectively received by the antenna. The antenna just described is designed to receive conventional FM radio signals, in the 80–108 MHz range. The antenna reception elements, 14, 16 and 18, have sides which are 58.7-inches in length. This represents ½ the wavelength (λ) of a 100 MHz median signal. Spacing of the elements relative one another causes the antenna to resonate at 300 ohms at 100 MHz. Dimensions for spacing are illustrated in FIG. 2, where, in the preferred embodiment, dimension A is 1.5-inches, dimension B is 0.93-inches and dimension C is 1.0-inches, C being less than 0.01 λ (1.17 in.). The distance between the first and second terminals on each reception element is 3.1-inches. An antenna having this particular geometry has been determined to produce FM signals having high gain at the antenna terminals.

The antenna provides parallel paths for RF energy over its three conductive reception elements. The RF energy is collected and transmitted to an FM receiver by means of mutual couplers 32 and 34. The multiple, parallel, mutually coupled reception elements further provide reception of plural in-phase signals which reinforce, rather than cancel out, one another because they are mounted within 0.01 λ from central axis 13. The antenna is also suitable for use with UHF frequencies by merely changing the length of the reception elements, and proportionally changing dimensions A, B and C to correspond with a desired median frequency.

While the present invention has been described with reference to the foregoing preferred embodiment, it is to be understood that other changes in form and detail may be made within the spirit and scope of the invention as defined in the claims which now follow.

It is claimed and desired to secure as Letters Patent:

1. An FM antenna which is tuned for receiving a range of signals having a known median wavelength (λ) for use with a radio receiver comprising a non-electrically conductive elongate frame, three mutually equidistantly spaced generally mutually parallel dipole pairs mounted on said frame, said dipole pairs being disposed generally equiangularly about and parallel with said frame's major axis, said dipole pairs being spaced at a distance of less than 0.01 λ from said frame's major axis, coupling means operatively, simultaneously, connected to said dipole pairs, and lead means joined to said coupling means and connectable to a radio receiver.

2. The antenna of claim 1, wherein said coupling means includes first and second couplers, and said dipole pairs form open-loop conductors, one of the dipoles of each dipole pair having first and second electrically spaced terminals interposed intermediate its ends, said first and second couplers electrically joining the first and second terminals, respectively, of said three dipole pairs.

3. The antenna of claim 1 wherein said dipoles are all a known common length which is integrally divisible into the known median wavelength.

4. The antenna of claim 3, wherein said dipoles are of a length substantially equal to ½ the known median wavelength.

5. The antenna of claim 2, which further includes a supportable weather-tight container for receiving therein said frame and said conductive elements, said container having at least one port through which said lead means extends.

6. An FM antenna for receiving a range of signals having a known median wavelength comprising plural electrically spaced elongate open loop conductor means, wherein the sides of said conductor means are of a common length substantially equal to ½ the known median wavelength and wherein said conductor means are disposed within 1/100 the known median wavelength of a common reference, each conductor means terminating at a pair of electrically spaced terminals, a pair of mutual coupling means, one coupling means connects one of the terminals of each of said conductor means with the corresponding terminals of the other conductor means and the other coupling means connects the other terminals, and lead means electrically operatively joined to said coupling means and connectable to a radio receiver.

7. The antenna of claim 6, wherein said conductor means are disposed generally parallel to, equiangularly about and equidistant from an axis and further are disposed generally equidistant from each other.

* * * * *